US008814161B2

(12) United States Patent
Yamakawa et al.

(10) Patent No.: US 8,814,161 B2
(45) Date of Patent: Aug. 26, 2014

(54) SHEET TRANSPORTING DEVICE AND IMAGE FORMING APPARATUS WITH REGULATING MEMBER AND FIRST TRANSPORT MEMBER MOVING TOGETHER

(75) Inventors: Yoichi Yamakawa, Kanagawa (JP); Michio Tada, Kanagawa (JP); Takashi Abe, Kanagawa (JP); Yoshiyuki Takaishi, Kanagawa (JP); Yousuke Hasegawa, Tokyo (JP); Hisakazu Onoe, Kanagawa (JP); Makio Uehara, Kanagawa (JP); Yasunobu Gotoh, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 202 days.

(21) Appl. No.: 13/287,516

(22) Filed: Nov. 2, 2011

(65) Prior Publication Data

US 2012/0288309 A1 Nov. 15, 2012

(30) Foreign Application Priority Data

May 13, 2011 (JP) ..... 2011-107893

(51) Int. Cl.
*B65H 9/04* (2006.01)
*B65H 9/00* (2006.01)
*B65H 9/06* (2006.01)

(52) U.S. Cl.
CPC . *B65H 9/004* (2013.01); *B65H 9/06* (2013.01)
USPC ..... 271/243; 271/272; 271/273; 399/395

(58) Field of Classification Search
USPC ..... 271/243, 270, 272, 273; 399/395, 396
See application file for complete search history.

(56) References Cited

U.S. PATENT DOCUMENTS

| | | | | | |
|---|---|---|---|---|---|
| 2,262,631 | A | * | 11/1941 | Belluche | 271/243 |
| 2,363,766 | A | * | 11/1944 | Williams | 271/246 |
| 3,336,026 | A | * | 8/1967 | Preuss | 271/243 |
| 3,870,293 | A | * | 3/1975 | Simeth | 271/245 |
| 5,039,086 | A | | 8/1991 | Matsuno et al. | |
| 5,172,898 | A | * | 12/1992 | Takahashi | 271/243 |
| 5,374,053 | A | | 12/1994 | Doucet et al. | |
| 8,434,759 | B2 | * | 5/2013 | Abe et al. | 271/243 |
| 2009/0250869 | A1 | | 10/2009 | Muller et al. | |

FOREIGN PATENT DOCUMENTS

| | | |
|---|---|---|
| JP | A-02-070639 | 3/1990 |
| JP | A-07-215545 | 8/1995 |
| JP | B2-4147182 | 9/2008 |
| JP | A-2009-221021 | 10/2009 |

* cited by examiner

*Primary Examiner* — Gerald McClain
(74) *Attorney, Agent, or Firm* — Oliff PLC

(57) ABSTRACT

A sheet transporting device includes a regulating member that is arranged so that an edge of a sheet is abutted against the regulating member while moving downstream in a transporting direction of the sheet, and a first transport member that transports the sheet toward the regulating member while moving downstream in the transporting direction, and that pushes the sheet against the regulating member while slipping on a surface of the sheet in a state where the sheet is abutted against the regulating member, wherein the regulating member and the first transport member moving together downstream in the transporting direction.

9 Claims, 6 Drawing Sheets

SHEET TRANSPORTING DEVICE AND IMAGE FORMING APPARATUS WITH REGULATING MEMBER AND FIRST TRANSPORT MEMBER MOVING TOGETHER

CROSS-REFERENCE TO RELATED APPLICATIONS

This application is based on and claims priority under 35 USC 119 from Japanese Patent Application No. 2011-107893 filed May 13, 2011.

BACKGROUND

Technical Field

The present invention relates to a sheet transporting device and an image forming apparatus.

SUMMARY

According to an aspect of the invention, there is provided a sheet transporting device including:

a regulating member is arranged so that an edge of a sheet is abutted against the regulating member while moving toward downstream in a transporting direction of the sheet; and a first transport member that transports the sheet toward the regulating member while moving toward the downstream in the transporting direction, and that pushes the sheet against the regulating member while slipping on a surface of the sheet in a state where the sheet is abutted against the regulating member, wherein the regulating member and the first transport member moving together toward the downstream in the transporting direction.

BRIEF DESCRIPTION OF THE DRAWINGS

Exemplary embodiments of the present invention will be described in detail based on the following figures, wherein.

DETAILED DESCRIPTION

Exemplary embodiments of the invention will be described below in detail with reference to the accompanying drawings.

Figure 1:
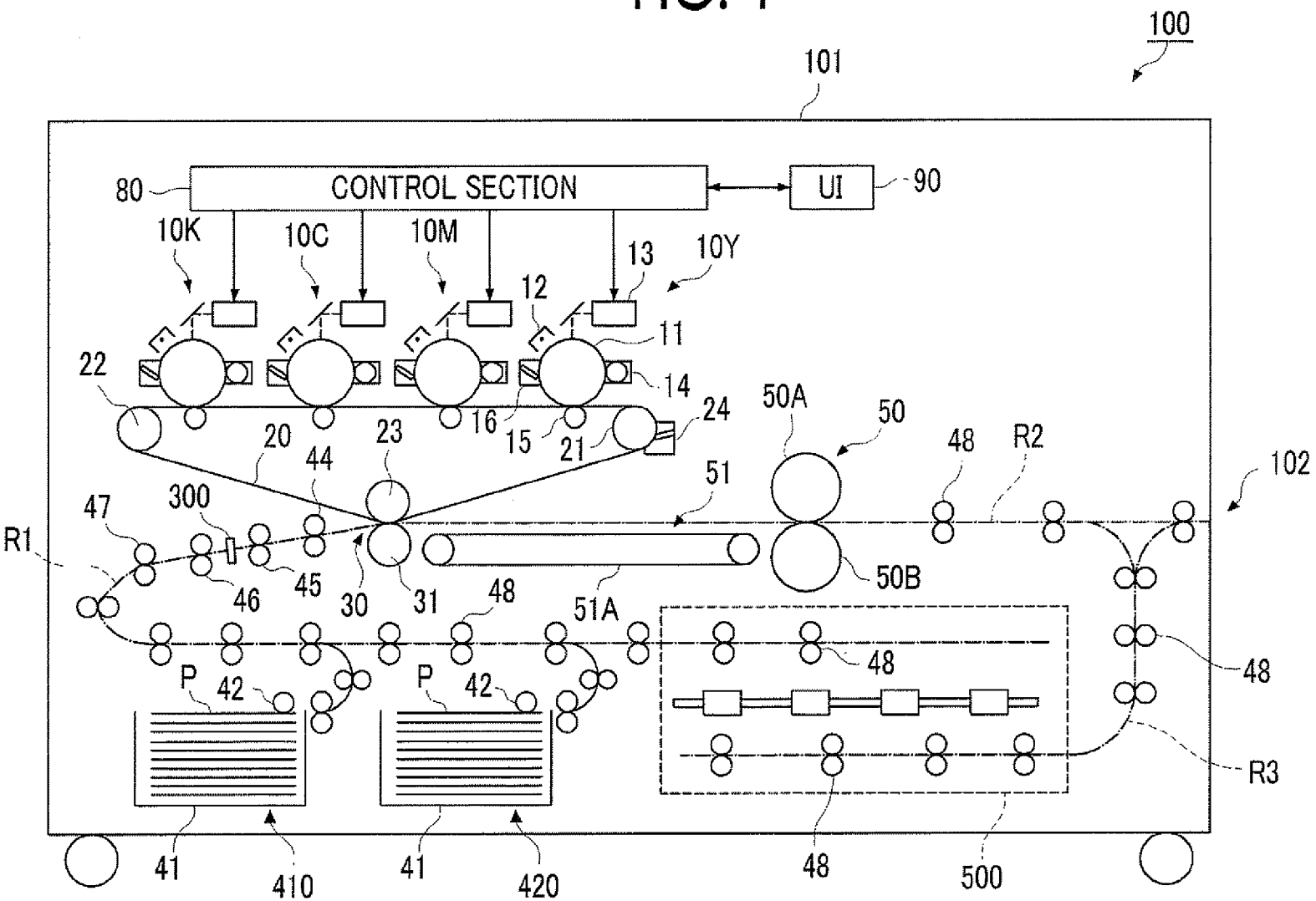
FIG. 1 is a view when an image forming apparatus to which the present exemplary embodiment is applied is viewed from the front side.

FIG. 1 is a view when an image forming apparatus 100 to which the present exemplary embodiment is applied is viewed from the front side. The image forming apparatus 100 shown in FIG. 1 has a tandem configuration, and includes plural image forming units 10 (10Y, 10M, 10C, and 10K) that form toner images of respective color components, using an electrophotographic method. Additionally, the image forming apparatus 100 is provided with a control section 80 that controls the operation of respective devices and respective sections that constitute the image forming apparatus 100. Additionally, the image forming apparatus 100 is provided with a user interface section (UI) 90 that is constituted by a display panel and that outputs an instruction received from a user to the control section 80, and presents a user the information from the control section 80.

Additionally, the image forming apparatus 100 includes an intermediate transfer belt 20 to which the respective color component toner images formed in the respective image forming units 10 are sequentially transferred (primarily transferred), and that carries these toner images, and a secondary transfer device 30 that collectively transfers (secondarily transfers) the toner images on the intermediate transfer belt 20 to sheet P. Here, the respective image forming units 10, the intermediate transfer belt 20, and the secondary transfer device 30 may be regarded as a toner image forming section that forms an image on sheet P. Additionally, a first sheet transporting path R1 through which the sheet P transported toward the secondary transfer device 30 passes, a second sheet transporting path R2 through which that the sheet P after passing through the secondary transfer device 30 passes, and a third sheet transporting path R3 that branches from the second sheet transporting path R2 on the downstream side of the fixing device 50 (as will be described below) and extends to below the first sheet transporting path R1 is provided in the image forming apparatus 100.

Additionally, a reverse mechanism 500 that transports sheet P from the third sheet transporting path R3 to the first sheet transporting path R1 and reverses the front and back of the sheet P is provided. Moreover, an opening 102 is formed in a housing 101 of the image forming apparatus 100. Here, the sheet P transported along the second sheet transporting path R2 is ejected to the outside of the housing 101 through the opening 102, and is stacked on a sheet stacking section (not shown). In addition, a processing device (not shown) is provided adjacent to the housing 101, so that processing, such as punching, may also be performed on the sheet P ejected from the opening 102.

Additionally, the image forming apparatus 100 is provided with a first sheet supply device 410 that supplies sheet P to the first sheet transporting path R1. Additionally, a second sheet supply device 420 that is provided on the upstream side of the first sheet supply device 410 in the transporting direction of sheet P, and supplies sheets P to the first sheet transporting path R1 is provided. In addition, the first sheet supply device 410 and the second sheet supply device 420 are similarly configured, and the first sheet supply device 410 and the second sheet supply device 420 are respectively provided with a sheet storage unit 41 that stores sheets P, and a feed roll 42 that feeds the sheets P stored in the sheet storage unit 41 to transport the sheets P.

Additionally, a first feed roll 44 that transports the sheet P on the first sheet transporting path R1 toward the secondary transfer device 30 is provided on the upstream side of the secondary transfer device 30 on the first sheet transporting path R1. Moreover, a second feed roll 45 that transports the sheet P toward the first feed roll 44, a third feed roll 46 that transports the sheet P toward the second feed roll 45, and a fourth feed roll 47 that transports the sheet P toward the third feed roll 46 are provided. Additionally, in addition to these feed rolls, plural feed rolls 48 that transport the sheet P located on the first sheet transporting path R1, the second sheet transporting path R2, and the third sheet transporting path R3 are provided on these sheet transporting paths.

Additionally, a regulating member 300 formed of stainless steel against which the leading edge of the sheet P is abutted is provided between the second feed roll 45 and the third feed roll 46. In the present exemplary embodiment, the skew (the inclination of the sheet P with respect to the transporting direction) of the sheet P is corrected as the leading edge of the sheet P is abutted against the regulating member 300. In addition, after the skew of the sheet P is corrected by the regulating member 300, the regulating member 300 withdraws from the first sheet transporting path R1.

Additionally, the fixing device 50 that fixes an image secondarily transferred onto the sheet P by the secondary transfer device 30 on this sheet P is provided on the second sheet transporting path R2. The fixing device 50 is provided with a heating roller 50A heated by a built-in heater (not shown) and a pressing roll SOB that presses the heating roller 50A. In the fixing device 50, the sheet P is pressurized and heated as the sheet P passes through between the heating roller 50A and the pressing roll 50B. Thereby, the image on the sheet P is fixed on the sheet P.

Additionally, a transport device 51 that transports the sheet P that has passed through the secondary transfer device 30 to the fixing device 50 is provided between the secondary transfer device 30 and the fixing device 50. Here, the transport device 51 has a belt 51A that moves circularly, and places the sheet P on the belt 51A to perform transport of the sheet P.

Here, each of the image forming units 10 includes a rotatably attached photoreceptor drum 11. Additionally, a charging device 12 that charges the photoreceptor drum 11, an exposure device 13 that exposes the photoreceptor drum 11 to write an electrostatic latent image onto it, and a developing device 14 that forms the electrostatic latent image on the photoreceptor drum 11 as a visible image with a toner are provided around the photoreceptor drum 11. Moreover, a primary transfer device 15 that transfers each color component toner image formed on the photoreceptor drum 11 to the intermediate transfer belt 20, and a drum cleaning device 16 that removes the residual toner on the photoreceptor drum 11 are provided.

The intermediate transfer belt 20 is stretched over three roll members 21 to 23, and is provided so as to rotate. The roll member 22 among these three roll members 21 to 23 drives the intermediate transfer belt 20. Additionally, the roll member 23 is arranged to face the secondary transfer roller 31 with the intermediate transfer belt 20 therebetween, and the secondary transfer device 30 is constituted by the secondary transfer roller 31 and the roll member 23. In addition, the belt cleaning device 24 that removes the residual toner on the intermediate transfer belt 20 is provided at a position that faces the roll member 21 with the intermediate transfer belt 20 therebetween.

Additionally, in the image forming apparatus 100 of the present exemplary embodiment, not only an image may be formed on one surface of the sheet P supplied from the first sheet supply device 410 or the like, but an image may be formed on the other surface of the sheet P. More specifically, in the image forming apparatus 100, the front and back of the sheet P that has passed through the fixing device 50 is reversed by the reverse mechanism 500, and the sheet P of which the front and back are reversed is to be transported again to the secondary transfer device 30. Then, an image is transferred to the other surface of the sheet P in the secondary transfer device 30. Then, the sheet P passes through the fixing device 50 again, and the transferred image is fixed on the sheet P. Thereby, images are formed not only on one surface of the sheet P but also on the other surface thereof.

Figure 2:
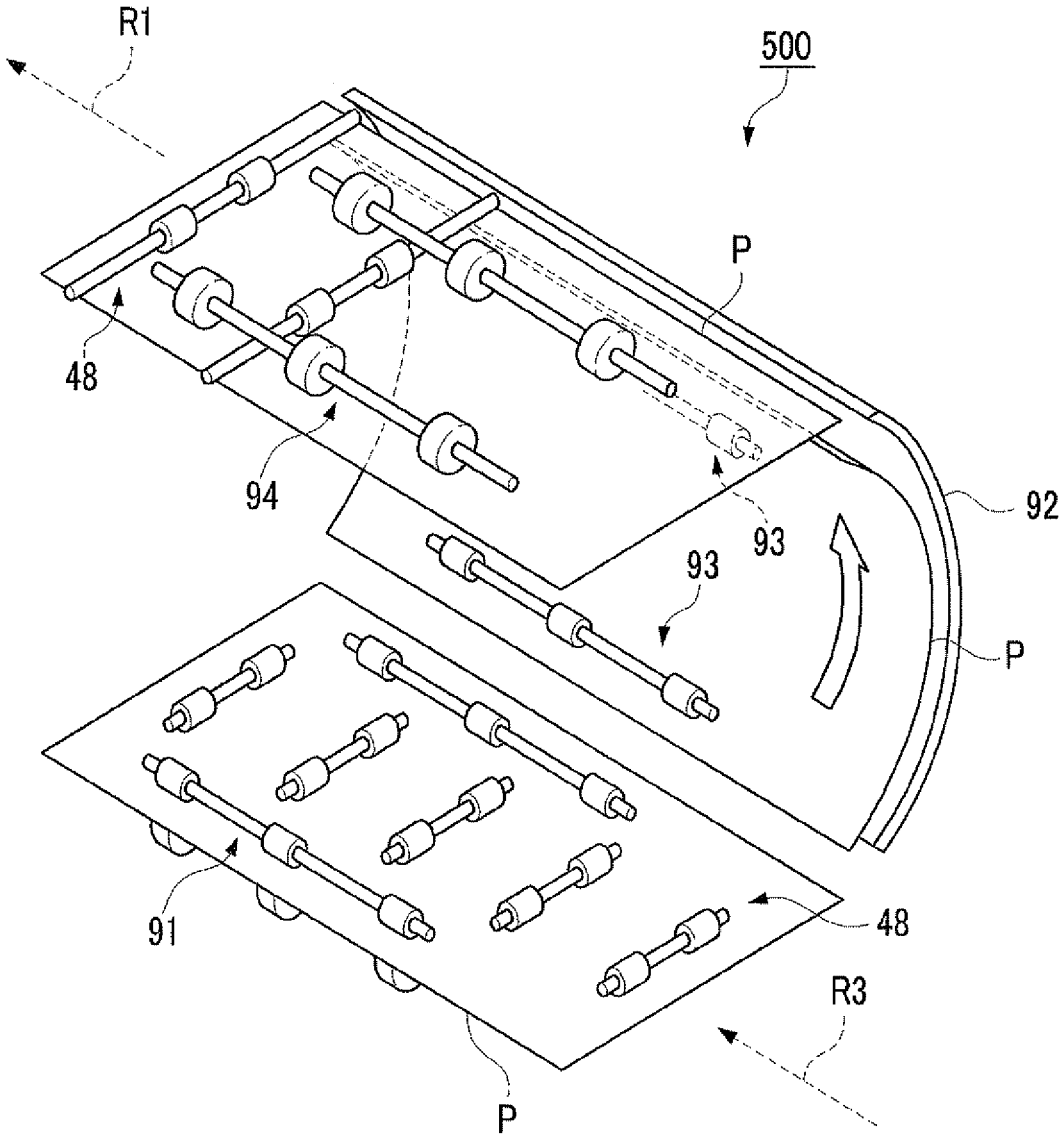
FIG. 2 is a view for describing the reverse mechanism.

FIG. 2 is a view for describing the reverse mechanism 500.

As described above, the third sheet transporting path R3 is provided with plural feed rolls 48 that transport sheet P along the third sheet transporting path R3. Additionally, the first sheet transporting path R1 is also provided with plural feed rolls 48 that transport the sheet P along the first sheet transporting path R1.

Additionally, the third sheet transporting path R3 is provided with a feed roll 91 that transports the sheet P toward a direction orthogonal (intersecting) the transporting direction of the sheet P in the third sheet transporting path R3. To elaborate, the feed roll 91 that transports sheet P toward the side of the third sheet transporting path R3 is provided.

Moreover, a guide member 92 that guides sheet P is provided such that the sheet P transported by the feed roll 91 moves upward, and the sheet P that has moved upward further moves toward the first sheet transporting path R1. Moreover, a feed roll 93 that nips the sheet P that is guided by the guide member 92 and has a leading edge turned upward, and transports this sheet P further upward is provided.

Additionally, the first sheet transporting path R1 is provided with a feed roll 94 that transports the sheet P transported by the feed roll 93 to a predetermined location on the first sheet transporting path R1.

In addition, each of the feed rolls 48 is constituted of a pair of roll-like members, and performs transport of sheet P while pinching the sheet P using the pair of roll-like members. Additionally, only one roll-like member of the pair of roll-like members is shown in FIG. 2. Moreover, the feed roll 91, the feed roll 93, and the feed roll 94 are also the same, and rotates while pinching and rotating the sheet P a pair of roll-like members, to perform transport of sheet P.

Additionally, one roll-like member provided in the feed roll 48 is adapted to be capable of being separated from the other roll-like member. Additionally, the feed roll 91 and the feed roll 94 are also the same, and one roll-like member provided in the feed roll 91 is adapted to be capable of being separated from the other roll-like member. Moreover, although not shown, a separating mechanism (not shown) is provided to separate one roll-like member from the other roll-like member is provided. In addition, this separating mechanism is constituted of an existing technique, such as a motor and a cam.

When the reverse of the front and back of sheet P is performed by the reverse mechanism 500, the sheet P is first transported along the third sheet transporting path R3 by the feed rolls 48. In addition, at this time, one roll-like member of the feed roll 91 provided in the third sheet transporting path R3 separates from the other roll-like member. Next, one roll-like member of the feed roll 48 separates from the other roll-like member, and one roll-like member of the feed roll 91 is pressed against the other roll-like member via the sheet P.

Next, the feed roll 91, the feed roll 93, and the feed roll 94 are rotationally driven, and the sheet P is transported toward the first sheet transporting path R1. In addition, at this time, one roll-like member of the feed roll 48 provided in the first sheet transporting path R1 separates from the other roll-like member. Then, if the sheet P is transported to a predetermined location on the first sheet transporting path R1, the rotational driving of the feed roll 91, the feed roll 93, and the feed roll 94 is stopped. Thereafter, one roll-like member in the feed roll 94 separates from the other roll-like member, and one roll-like member of the feed roll 48 provided in the first sheet transporting path R1 is pressed against the other roll-like member via the sheet P.

Next, the feed roll 48 is rotationally driven, whereby the sheet P is transported toward the first sheet transporting path R1. In addition, the sheet P is brought into a state where the front and back of thereof is already reversed. Here, in the reverse mechanism 500, the present exemplary embodiment, the reverse of the front and back of sheet P is performed without replacing the leading edge and trailing edge of the sheet P in the transporting direction. On the other hand, in the reverse mechanism 500 in the present exemplary embodiment, one side end (side end that connects the leading edge and trailing edge of sheet P) of sheet P and the other side end are replaced with each other.

Figure 3:
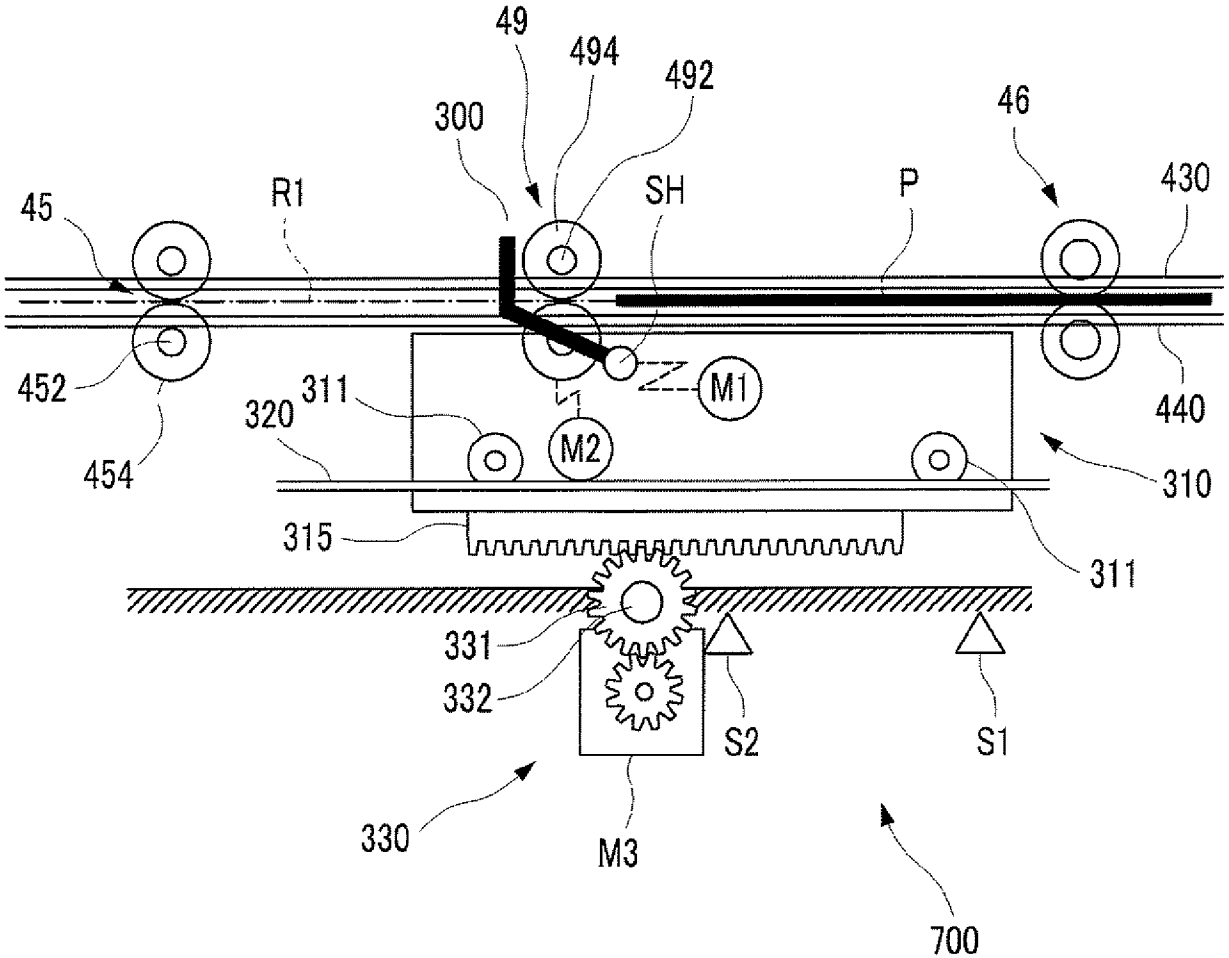
FIG. 3 is a side view of the periphery of the regulating member shown in FIG. 1.
Figure 4:
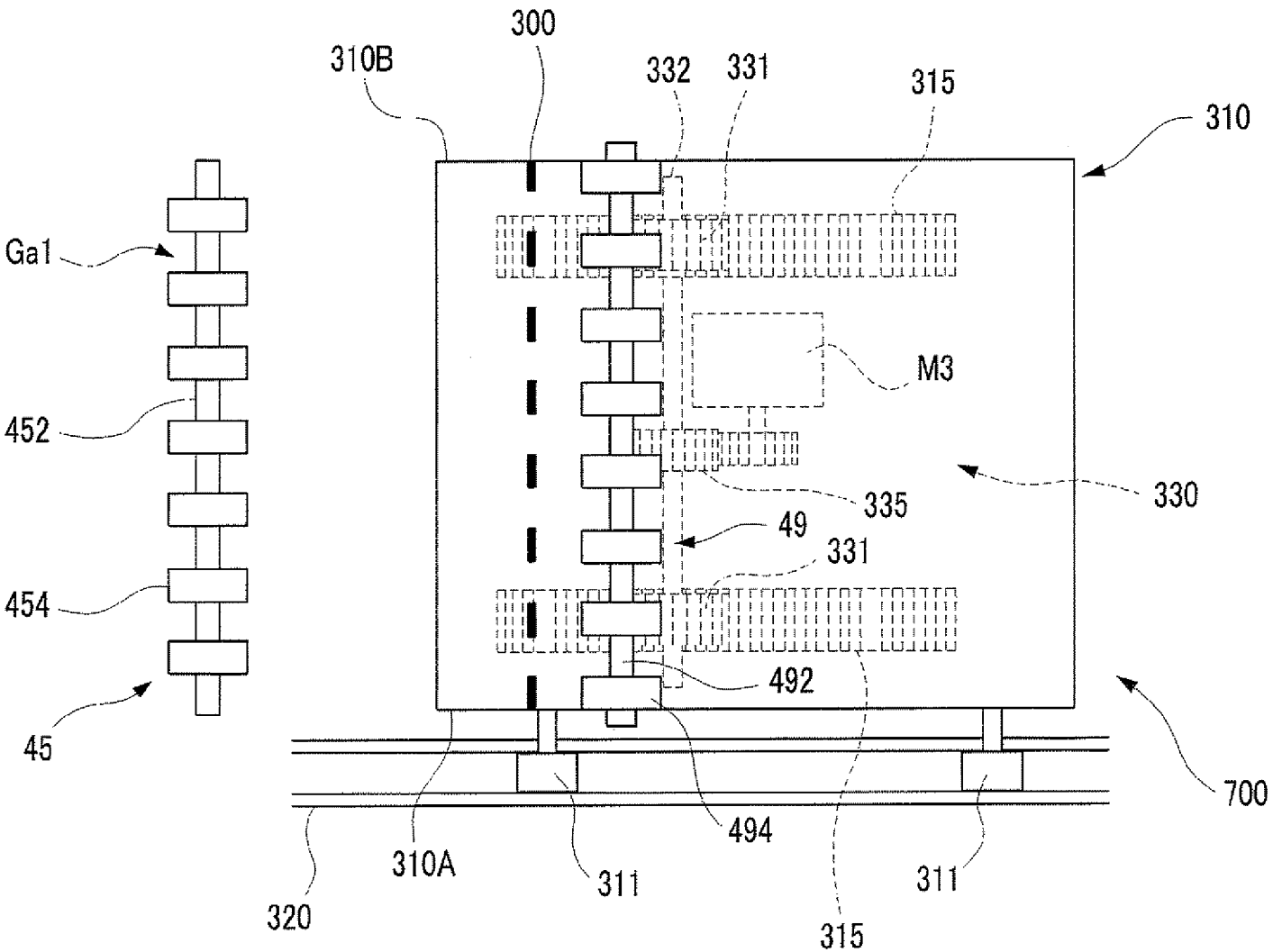
FIG. 4 is a plan view of the periphery of the regulating member shown in FIG. 1.

FIG. 3 is a side view of the periphery of the regulating member 300 shown in FIG. 1. Additionally, FIG. 4 is a plan view of the periphery of the regulating member 300 shown in FIG. 1. Here, the side view when the image forming apparatus 100 shown in FIG. 1 is viewed from the rear side is shown in FIG. 3. Additionally, only the portion of the regulating member 300 that protrudes to the first sheet transporting path R1 (refer to FIG. 3) is shown in FIG. 4.

As shown in FIG. 3, the regulating member 300 is arranged so as to be movable along the transporting direction (the first sheet transporting path R1) of sheet P between the second feed roll 45 and the third feed roll 46. Additionally, the regulating member 300 is formed in the shape of the letter L, and is provided so as to be rotatable (rockable) about one end. More specifically, as the regulating member 300 rotates (rocks) about one end, the other end of the regulating member 300 is provided so as to be capable of advancing and retreating with respect to the first sheet transporting path R1.

Additionally, as shown in FIG. 4, plural regulating members 300 are provided in a direction intersecting (orthogonal to) the transporting direction of sheet P. Moreover, the respective regulating members 300 are arranged in a row at predetermined intervals.

Although illustration is omitted in FIG. 1, an upper guide 430 and a lower guide 440 (refer to FIG. 3) that form the first sheet transporting path R1 are provided between the second feed roll 45 and the third feed roll 46.

As shown in FIG. 3, the upper guide 430 and the lower guide 440 are made of plate-shaped members, and are provided along the transporting direction of sheet P. More specifically, the first sheet transporting path R1 is pinched and formed between the upper guide 430 and the lower guide 440. That is, sheet P passes through between the upper guide 430 and the lower guide 440. The upper guide 430 and the lower guide 440 support the sheet P transported along the first sheet transporting path R1, and keeps sheet P from separating and deflecting from the first sheet transporting path R1. In the present exemplary embodiment, the gap between the upper guide 430 and the lower guide 440 is 1.5 mm.

Although illustration is omitted in FIG. 1, a slip roll 49 that transports sheet P is provided between the second feed roll 45 and the third feed roll 46. The slip roll 49 that is an example of a first transport member is composed of a pair of roll-like members capable of separating from each other, and is rotatably provided.

As shown in FIG. 4, each roll-like member of the slip roll 49 is formed by a rotating shaft 492 provided along a direction orthogonal to the transporting direction of sheet P, and a columnar contacting member 494 that is rotated by the rotating shaft 492 and has an outer peripheral surface contacting the sheet P.

Additionally, plural contacting members 494 are provided. The respective contacting members 494 are arranged at mutually different positions in the direction orthogonal to the transporting direction of sheet P. Specifically, the respective contacting members 494 are plurally provided at positions that correspond to the respective regulating member 300 that are plurally provided in the direction orthogonal to (intersecting) the transporting direction of sheet P.

Additionally, the slip roll 49 is weak in the force (transport force) of transporting sheet as compared to the second feed roll 45, the third feed roll 46, and the like grade that are other feed rolls. Specifically, the slip roll 49 has a low coefficient of friction between the slip roll and sheet P, compared to other feed rolls. More specifically, the transport force of the slip roll 49 is a magnitude which is equal to or more than a force required in order to transport sheet P. Additionally, the transport force of the slip roll 49 is smaller than the maximum force (buckling load) by which sheet P stretches without deflection when the sheet P is abutted against the regulating member 300. Although the details will be described below, in the present exemplary embodiment, the slip roll 49 transports sheet P up until the sheet P abuts against the regulating member 300, and slips on the sheet P if the sheet P abuts against the regulating member 300.

In addition, the transport force of the slip roll 49 that is rotating without slipping with respect to sheet P is obtained by the product of the static friction coefficient between the sheet P and the slip roll 49, and the nip pressure of the slip roll 49.

On the other hand, the transport force of the slip roll 49 that is rotating while slipping with respect to sheet P is obtained by the product of the dynamic friction coefficient between the sheet P and the slip roll 49, and the nip pressure of the slip roll 49. Additionally, the transport force of the slip roll 49 that is rotating while slipping with respect to sheet P is smaller than the transport force of the slip roll 49 that is rotating without slipping with respect to the sheet P.

Now, the slip roll 49 is provided so as to be movable in the transporting direction of sheet P together with the regulating member 300. Specifically, as shown in FIG. 4, both ends of the slip roll 49 are fixed to the carriage 310 (to be described below). The slip roll 49 moves along the transporting direction of sheet P as the carriage 310 moves.

Additionally, as shown in FIG. 3, the slip roll 49 and the regulating member 300 are arranged in proximity to each other. In the present exemplary embodiment, the gap between the regulating member 300 and the outer peripheral surface of the slip roll 49 in the transporting direction of sheet P is 1.5 mm. By arranging the slip roll 49 and the regulating member 300 in proximity to each other, sheet P is may kept from forming a loop (deflection) between the slip roll 49 and the regulating member 300.

The slip roll 49 is made of rubber (usually CR rubber), and is formed by mixing nylon powder into rubber. Additionally, as other materials, the slip roll is formed of urethane foam, foamed CR rubber, or the like.

Now, although the description is omitted above, a moving section 700 (refer to FIG. 3) that moves the regulating member 300 and the slip roll 49 between the second feed roll 45 and the third feed roll 46 along the transporting direction of sheet P is provided.

As shown in FIG. 3, the moving section 700 is provided with the carriage 310 that is provided so as to be movable along the transporting direction of sheet P, and supports the regulating member 300 and the slip roll 49. Additionally, the moving section 700 is provided with a rail 320 that guides the carriage 310 along the transporting direction of sheet P. Moreover, the moving section 700 is provided with a drive section 330 that moves the carriage 310.

The carriage 310 that is an example of a guide unit has a shaft SH that supports one-side ends of the regulating members 300 which are plurally provided. The shaft SH is rotatably provided so that the plurally provided regulating members 300 may integrally rotate (rock) about the shaft SH. Additionally, the carriage 310 has a motor M1 that rotates the shaft SH. Moreover, the carriage 310 has a motor M2 that rotates the slip roll 49. Moreover, the carriage 310 has wheels 311 supported by the rail 320. Moreover, the carriage 310 has a rack gear 315 that is arranged along the transporting direction of sheet P.

Here, as shown in FIG. 4, two rack gears 315 are provided at positions that are different in the direction intersecting (orthogonal to) the transporting direction of sheet P. Specifically, with the central position of the carriage 310 in the direction intersecting (orthogonal to) the transporting direction of sheet P therebetween, one rack gear 315 is provided on the side of a rear side end 310A in the carriage 310 and the other rack gear 315 is provided on the side of a front side end 3105 in the carriage 310.

The drive section 330 has pinion gear 331 that meshes with the rack gear 315. Additionally, the drive section 330 has a gear shaft 332 that is provided along the direction orthogonal to the transporting direction of sheet P to supports the pinion gear 331, and the motor M3 that rotates the pinion gear 331 via the gear shaft 332.

Moreover, as shown in FIG. 3, the drive section 330 has a first sensor S1 and a second sensor S2 that perform detection of the carriage 310. The first sensor S1 detects that the regulating member 300 is at a standby position where the regulating member waits for the sheet P transported from the upstream, via the carriage 310. Additionally, the second sensor S2 provided further downstream in the transporting direction of sheet P than the first sensor S1 and detects the regulating member 300 is at a withdrawal position where the regulating member withdraws from the first sheet transporting path R1, via the carriage 310. The first sensor s2 and the second sensor s2 support the regulating member 300. In addition, respective parts of the drive section 330 are fixed to the housing 101 (refer to FIG. 1) of the image forming apparatus 100.

Here, as shown in FIG. 4, two pinion gears 331 are provided at different positions in the direction intersecting (orthogonal to) the transporting direction of sheet P so as to respectively mesh with the two rack gears 315 provided as described above. Moreover, the two pinion gears 331 are provided on one gear shaft 332. Accordingly, the two pinion gears 331 rotate synchronously.

Additionally, in the present exemplary embodiment, the gear shaft 332 is rotated by the driving from the motor M3 in one location of the axial central portion. Specifically, as a central gear 335 fixed to the axial central portion of the gear shaft 332 is rotated by the driving from the motor M3, the gear shaft 332 rotates.

Here, the second feed roll 45 provided on the downstream side of the moving section 700 in the transporting direction of sheet P will be described, referring to FIGS. 3 and 4.

The second feed roll 45 that is an example of a second transport member is formed by a pair of roll-like members, and is rotated by the driving force from a drive source (not shown). Each roll-like member of the second feed roll 45 is formed by a rotating shaft 452 provided along the direction orthogonal to the transporting direction of sheet P, and a columnar contacting member 454 that is rotated by the rotating shaft 452 and has an outer peripheral surface contacting the sheet P.

Additionally, as shown in FIG. 4, plural contacting members 454 are provided. The respective contacting members 454 are arranged at mutually different positions in the direction orthogonal to the transporting direction of sheet P. Additionally, a gap Ga1 is formed between mutually adjacent contacting members 454. Each gap Ga1 and each regulating member 300 (each slip roll 49) are arranged at positions that correspond to each other in the direction intersecting (orthogonal to) the transporting direction of sheet P. Thereby, each regulating member 300 that moves toward the downstream side in the transporting direction of sheet P passes through the inside of the gap Ga1, and reaches a location that exceeds the second feed roll 45 (to be described below).

Now, movements of the respective parts when skew correction of sheet P is made will be described referring to FIGS. 3 to 5F. Here, FIGS. 5A to 5F are views showing the movements of the respective parts when the skew correction is performed.

First, as shown in FIGS. 5A to 5F, the regulating member 300 and the slip roll 49 arranged at predetermined positions further upstream than the second feed roll 45 move toward the downstream side in the transporting direction of sheet P by the moving section 700.

Here, the traveling speed of the carriage 310 and the transport speed of sheet P using the third feed roll 46 are set such that the transport speed of the sheet P using the third feed roll 46 becomes greater than the traveling speed of the carriage 310 (refer to FIG. 3) in the moving section 700. For this reason, if the sheet P is transported by the third feed roll 46, the sheet P approaches the slip roll 49 gradually. Then, the sheet P that has reached the slip roll 49 is further transported to the downstream side as the slip roll 49 moves toward the downstream side in the transporting direction, and the slip roll 49 rotates. Additionally, as the slip roll 49 rotates, the leading edge of the sheet P is butted against the regulating member 300.

Then, as the sheet P is butted against the regulating member 300, the slip roll 49 that applies a transport force smaller than the buckling load of the sheet P as described above begins to slip on the surface of the sheet P. That is, the slip roll 49 rotates (idles), sliding on the surface of the sheet P.

In addition, the slip roll 49 that rotates while slipping applies to the sheet P the force of pushing the sheet P to the downstream side in the transporting direction of the sheet P. Thereby, a state where the sheet P is butted against the regulating member 300 is maintained. Accordingly, the edge of the sheet P runs along the direction orthogonal to the transporting direction of the sheet P, and the skew of the sheet P is corrected. Additionally, the sheet P whose skew is corrected is kept from separating from the regulating member 300.

Additionally, since the slip roll 49 that rotates while slipping applies a transport force smaller than the buckling load of the sheet P to the sheet Pas described above, deflection is kept from occurring in the sheet P between the regulating member 300 and the slip roll 49. Moreover, since the regulating member 300 and the slip roll 49 are arranged in proximity to each other as described above, the portion of the sheet P between the regulating member 300 and the slip roll 49 is short, and deflection is kept from occurring in the sheet P.

In addition, the transport speed of the sheet P using the third feed roll 46, the traveling speed of the carriage 310, and the rotating speed of the slip roll 49 are set so as to avoid a situation where damage occurs in the sheet P as the sheet P is abutted against the regulating member 300.

Now, movements of the respective parts when skew correction of sheet P is made will be specifically described.

Figure 5A:
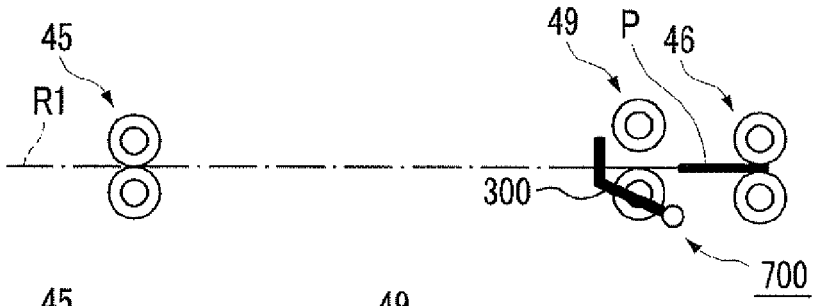
FIGS. 5A to 5F are views showing movements of respective parts when skew correction is performed.

First, as shown in FIG. 5A, the carriage 310 (refer to FIG. 3) stops at a standby position where the carriage waits for sheet P. The regulating member 300 supported by the carriage 310 advances into the transporting path of sheet P. Additionally, one roll-like member of the slip roll 49 supported by the carriage 310 withdraws from the other roll-like member, and one roll-like member and the other roll-like member are brought into a mutually separated state. Moreover, the slip roll 49 stops without rotating.

Then, sheet P is transported from the upstream by the third feed roll 46. If the leading edge of the sheet P is detected by a sheet detection sensor (not shown), the motor M3 (refer to FIG. 3) is driven, and the movement of the carriage 310 (refer to FIG. 3) to the downstream side in the transporting direction of the sheet P begins. As the carriage 310 moves, the sip roll 49 and the regulating member 300 move toward the downstream side (refer to FIG. 5B). The traveling speed of the carriage 310 is slower than the transport speed of the sheet P using the third feed roll 46 as described above.

Figure 5B:
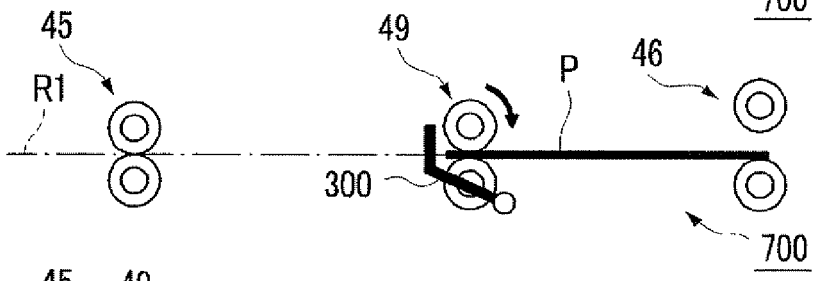

Additionally, if the sheet P is detected by the sheet detection sensor, the slip roll 49 begins to be rotated by the driving of the motor M2 (refer to FIG. 3). Moreover, the above one roll-like member contacts the other roll-like member, and the sheet P is held (nipped) by the slip roll 49. In addition, if the sheet P is held by the slip roll 49, as shown in FIG. 5B, one roll-like member of the third feed roll 46 separates from the other roll-like member.

Figure 5C:
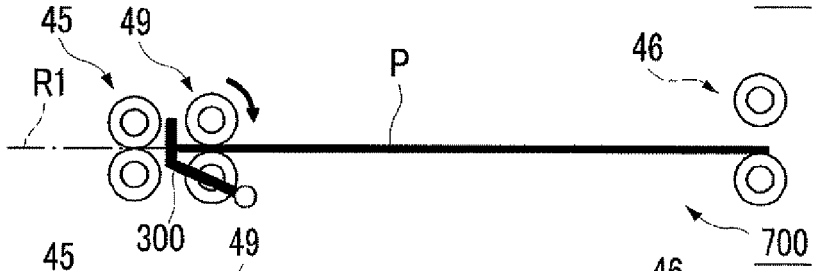
Figure 5D:
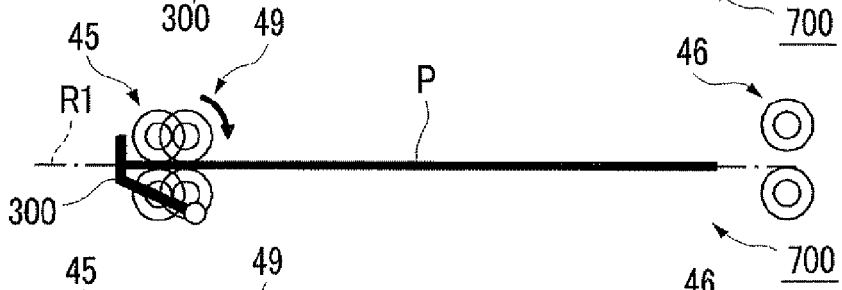

Then, as the slip roll 49 rotates, the sheet P is butted against the regulating member 300 (refer to FIG. 5C). Thereby, the skew of the sheet P is corrected. Next, as shown in FIG. 5D, the regulating member 300 against which the leading edge of sheet P is butted reaches a location that exceeds the second feed roll 45. Then, the sheet P is held (nipped) by the second feed roll 45, and transport of the sheet P using the second feed roll 45 is started.

Figure 5E:
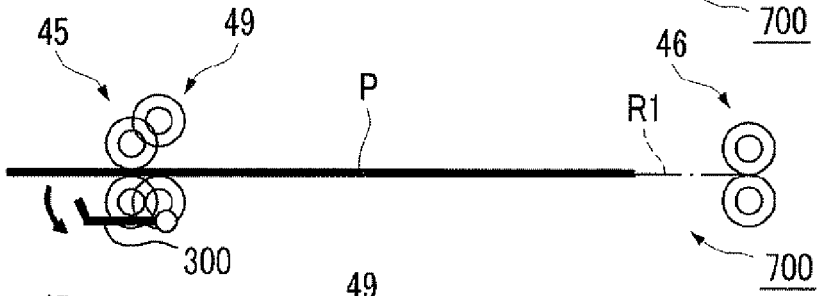

Then, after the sheet P is held by the second feed roll 45, one roll-like member of the slip roll 49 separates from the other roll-like member, and the slip roll 49 stops to rotate. Additionally, as the motor M1 (refer to FIG. 3) drives, the regulating member 300 rotates downward, and the regulating member 300 withdraws from the first sheet transporting path R1. Next, as shown in FIGS. 5E and 5F, the sheet P is further transported to the downstream side by the second feed roll 45.

Figure 5F:
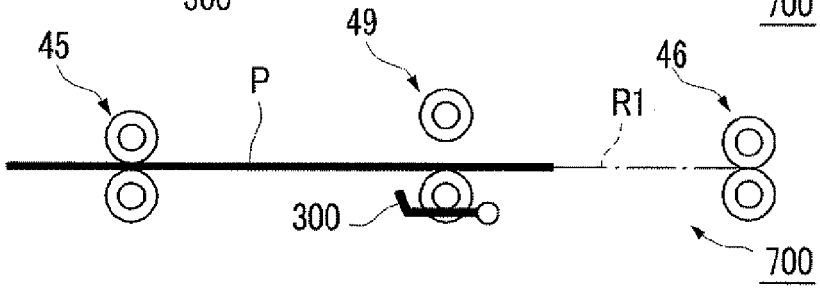

On the other hand, as shown in FIG. 5F, the regulating member 300 out of the first sheet transporting path R1, and the slip roll 49 in a separating state move toward the upstream side in the transporting direction of the sheet P, and return to an original state (the state of FIG. 5A). Here, in the present exemplary embodiment, the second sensor S2 (refer to FIG. 3) no longer detect the carriage 310 after the regulating member 300 reaches the second feed roll 45. Thereby, the motor M3 is reversed, and the carriage 310 moves toward the upstream side in the transporting direction of the sheet P. Then, if the carriage 310 is detected by the first sensor S1 (refer to FIG. 3), the driving of the motor M3 is stopped, and the carriage 310 stops. Thereby, the regulating member 300 and the slip roll 49 return to predetermined positions further upstream than the second feed roll 45. In addition, in the present exemplary embodiment, the reversing of the motor M1 is performed when the carriage 310 moves toward the upstream side. Thereby, the regulating member 300 protrudes again onto the first sheet transporting path R1.

Now, generally, when the regulating member 300 separates from the leading edge of sheet P before the sheet P is held by the second feed roll 45, the sheet P may be skewed again before reaching the second feed roll 45 after the sheet P separates from the regulating member 300.

On the other hand, in the present exemplary embodiment, as described above, the regulating member 300 separates from the leading edge of sheet P after the sheet P is held by the second feed roll 45. For this reason, second skew is kept from occurring.

Additionally generally, the skew correction of sheet P may be performed as the sheet P is butted against not the moving regulating member 300 but the fixed regulating member 300 as described above. However, in this case, in order to prevent damage or the like of the sheet P caused as the sheet P abuts against the regulating member 300, it is necessary to greatly reduce the transport speed of the sheet P or to stop the transport of the sheet P first. Then, in this case, the number of sheets of the sheet P capable of being transported per unit time becomes fewer, and productivity decreases.

On the other hand, in the configuration in the present exemplary embodiment, the transport speed of the sheet P using the third feed roll 46, the traveling speed of the carriage 310, and the rotating speed of the slip roll 49 are set to be low so as not to cause damage in sheet P. Accordingly, the skew correction is allowed while suppressing damage of sheet P without performing stop or the like of transport of the sheet P. Thereby, productivity increases compared to a configuration in which the regulating member 300 is fixed.

Moreover, generally, when sheet P is transported along the first sheet transporting path R1 pinched by the upper guide 430 and the lower guide 440, if deflection occurs in the sheet P, the sheet P and the upper guide 430 may contact each other and the sheet P to be transported may receive resistance. Since the sheet P receives resistance in this way, the edge of the sheet P may separate from the regulating member 300, and the sheet P may be skewed again. Additionally, as the skewed sheet P reaches the second feed roll 45, jamming (sheet jamming) may occur in the second feed roll 45.

On the other hand, in the present exemplary embodiment, deflection is may kept from occurring in sheet P as described above. Accordingly, second skewing or jamming in the second feed roll 45 is may kept from occurring.

Figure 6A:
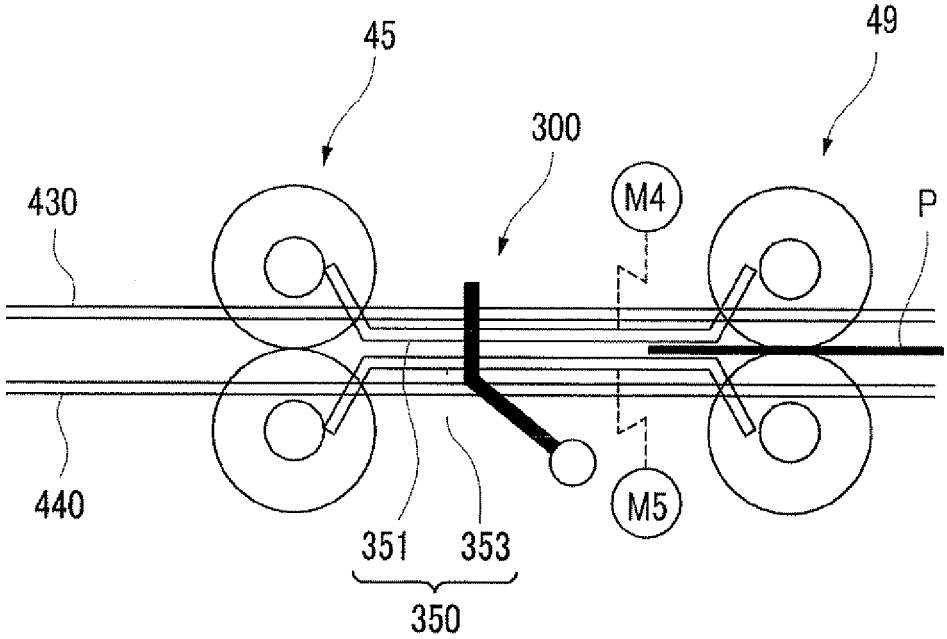
FIGS. 6A and 6B are side views of the periphery of a regulating member in another exemplary embodiment.
Figure 6B:
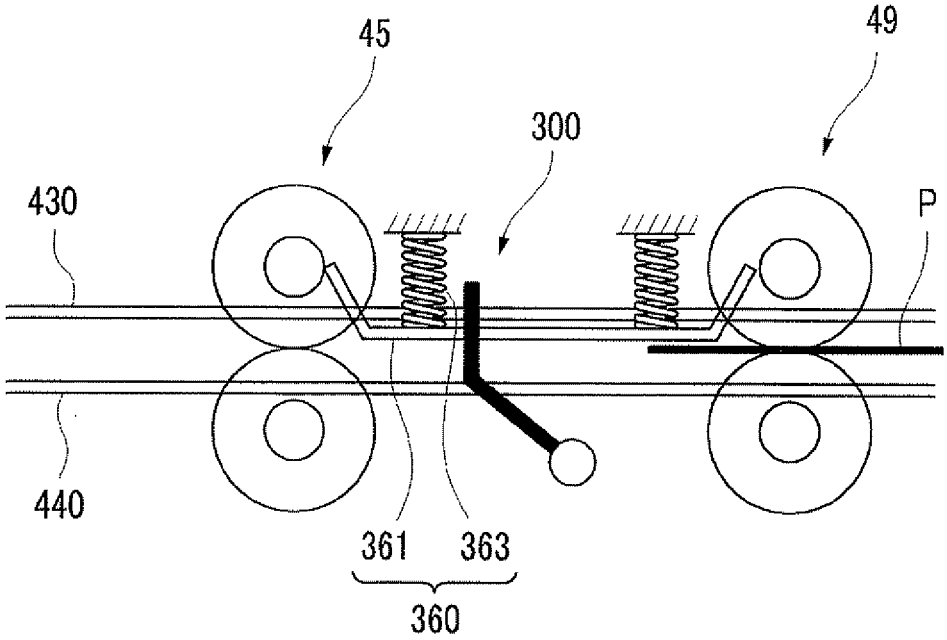

FIGS. 6A and 6B are side views of the periphery of a regulating member 300 in another exemplary embodiment. In addition, FIG. 5A is a side view of an exemplary embodiment using a gap adjusting section 350, and FIG. 5B is a side view of an exemplary embodiment using a sheet control section 360. Here, members having the same functions as the members described above are designated by the same reference numerals, and the description thereof is omitted.

In the exemplary embodiment shown in FIG. 6A, the gap adjusting section 350 that adjusts the height (the length in the vertical direction in FIGS. 6A and 6B) of the first sheet transporting path R1 (refer to FIGS. 5A to 5F) between the upper guide 430 and the lower guide 440 is provided. The gap adjusting section 350 has a pair of plate-shaped members (a top plate 351 and a bottom plate 353) fixed to the housing 101 (refer to FIG. 1) of the image forming apparatus 100. The first sheet transporting path R1 is formed between the top plate 351 and the bottom plate 353. That is, sheet P passes through between the top plate 351 and the bottom plate 353.

Additionally, the gap between the top plate 351 and bottom plate 353 in the present exemplary embodiment may be adjusted. The gap between the top plate 351 and the bottom plate 353 is adjusted by the existing technique, such as motors M4 and M5 and a cam (not shown) that are examples of a guide unit.

Moreover, the slip roll 49 in the present exemplary embodiment is provided so as to be fixed to the housing 101 (refer to FIG. 1) of the image forming apparatus 100. Additionally, the traveling speed of the carriage 310 and the transport speed of sheet P using the slip roll 49 are set such that the transport speed of the sheet P using the slip roll 49 becomes greater than the traveling speed of the carriage 310 (refer to FIG. 3) in the moving section 700.

Now, the operation of the respective parts in the present exemplary embodiment will be described. Additionally, as the slip roll 49 whose position is fixed rotates, the leading edge of sheet P is butted against the regulating member 300 that moves to the downstream side in the transporting direction of the sheet P. Thereby, the skew of the sheet P is corrected. Then, the slip roll 49 continues rotating, and the sheet P is transported to the downstream side in the transporting direction, being accompanied by slipping on the surface of the sheet P. Thereby, a state where the sheet P is butted against the regulating member 300 is maintained.

Here, since the distance between the regulating member 300 and the slip roll 49 increases, the sheet P is brought into a state where the sheet P is easy to deflect as the slip roll 49 transports the sheet P. In the present exemplary embodiment, the top plate 351 and the bottom plate 353 keeps deflection from occurring in sheet P.

Additionally, in the present exemplary embodiment, sheet P is more reliably kept from deflecting by adjusting the gap between the top plate 351 and the bottom plate 353 according to the thickness of the sheet P. Specifically, when the sheet P on which an image is formed by the image forming apparatus 100 (refer to FIG. 1) is switched, a contacting/separating mechanism (not shown) is driven, for example, by input in a user interface section 90 (referring to FIG. 1). The position between the top plate 351 and the bottom plate 353 is changed by the driving of the contacting/separating mechanism. That is, when the thickness of sheet P is large, the gap between the top plate 351 and the bottom plate 353 becomes large, and when the thickness of sheet P is small, the gap between the top plate 351 and the bottom plate 353 becomes small.

In addition, if the gap between the top plate 351 and the bottom plate 353 is too large as compared to the thickness of sheet P, deflection of the sheet P is apt to occur, and if the gap between the top plate 351 and the bottom plate 353 is too small as compared to the thickness of sheet P, the resistance that the sheet P receives from the top plate 351 and the bottom plate 353 becomes large.

In addition, although the configuration in which the slip roll 49 is provided so as to fixed to the housing 101 (refer to FIG. 1) of the image forming apparatus 100 has been described in the present exemplary embodiment, a configuration in which the slip roll is provided at the carriage 310 (refer to FIG. 3) may be adopted.

Next, the exemplary embodiment shown in FIG. 6B will be described. In the present exemplary embodiment, the sheet control section 360 that controls sheet P is provided between the upper guide 430 and the first sheet transporting path R1. The sheet control section 360 has a plate-shaped part 361 arranged along the first sheet transporting path R1, and a spring part 363 that is an example of an elastic member that presses the plate-shaped part 361 toward the first sheet transporting path R1. The plate-shaped part 361 is capable of advance and retreat with respect to the first sheet transporting path R1 as the spring part 363 that is an example of the a sheet guide part expands and contracts.

In addition, sheet P passes through between the plate-shaped part 361 and the lower guide 440. In addition, the slip roll 49 is fixed to the housing 101 (refer to FIG. 1) of the image forming apparatus 100.

In the present exemplary embodiment, the plate-shaped part 361 keeps the portion of sheet P that has passed through the slip roll 49 from deflecting. Additionally, when the thickness of sheet P is small, the sheet P passes below the plate-shaped part 361, and when the thickness of sheet P is large, the sheet P passes while pushing up the plate-shaped part 361. Accordingly, sheet P is reliably kept from deflected without changing settings according to the thickness of the sheet P.

In addition, although the configuration in which the sheet control section 360 is provided on one side (upper side) of the first sheet transporting path R1 has been described in the present exemplary embodiment, a configuration in which the sheet control sections 360 are provided on both sides (upper side and lower side) of the first sheet transporting path R1 may be adopted.

Additionally, although the configuration in which the slip roll 49 is provided so as to fixed to the housing 101 (refer to FIG. 1) of the image forming apparatus 100 has been described, a configuration in which the slip roll is provided at the carriage 310 (refer to FIG. 3) may be adopted.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A sheet transporting device comprising:

a regulating member is arranged so that an edge of a sheet is abutted against the regulating member while the regulating member is moving downstream in a transporting direction of the sheet; and a first transport member that transports the sheet toward the regulating member while the first transport member moves downstream in the transporting direction, and that pushes the sheet against the regulating member while slipping on a surface of the sheet in a state where the sheet is abutted against the regulating member, wherein the regulating member and the first transport member moving together downstream in the transporting direction with a distance between the regulating member and the first transport member being maintained constant.

2. The sheet transporting device according to claim 1 further comprising, a second transport member that transports the sheet transported in a state where the edge is abutted against the regulating member further downstream in the transporting direction.

3. The sheet transporting device according to claim 2 further comprising, a guide unit that narrows a path in a thickness direction of the sheet, the path is disposed between the first transport member and the second transport member, the sheet is transported via the path.

4. The sheet transporting device according to claim 3 further comprising, a third transport member that transports the sheet toward the first transport member at a speed faster than a moving speed of the first transport member.

5. The sheet transporting device according to claim 2, wherein the regulating member releases the sheet after the transport of the sheet by the second transport member is started.

6. The sheet transporting device according to claim 1 further comprising, a third transport member that transports the sheet toward the first transport member at a speed faster than a moving speed of the first transport member.

7. The sheet transporting device according to claim 1 further comprising, a moving member that moves along the transporting direction of the sheet, the regulating member and the first transport member being supported by the moving member.

8. The sheet transporting device according to claim 7 further comprising, a third transport member that transports the sheet toward the first transport member at a speed faster than a moving speed of the moving member.

9. An image forming apparatus comprising:

a sheet transporting device according to claim 1;

a second transport member that transports the sheet transported in a state where the edge is abutted against the regulating member further downstream in the transporting direction; and a toner image forming section that forms a toner image on the sheet transported from the second transport member.

* * * * *